US008979552B2

(12) United States Patent
Kiryu et al.

(10) Patent No.: US 8,979,552 B2
(45) Date of Patent: Mar. 17, 2015

(54) CONNECTOR AND METHOD FOR CONNECTING THE CONNECTOR

(71) Applicant: Fujitsu Component Limited, Tokyo (JP)

(72) Inventors: Koichi Kiryu, Nagano (JP); Kohei Takahashi, Tokyo (JP); Manabu Shimizu, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 91 days.

(21) Appl. No.: 13/897,548

(22) Filed: May 20, 2013

(65) Prior Publication Data

US 2013/0316595 A1 Nov. 28, 2013

(30) Foreign Application Priority Data

May 23, 2012 (JP) ..... 2012-117974

(51) Int. Cl.

| | |
|---|---|
| ***H01R 12/00*** | (2006.01) |
| ***H01R 13/422*** | (2006.01) |
| ***H01R 43/26*** | (2006.01) |
| ***H01R 12/71*** | (2011.01) |
| ***H01R 13/20*** | (2006.01) |

(52) U.S. Cl.

CPC ..... *H01R 13/422* (2013.01); *H01R 43/26* (2013.01); *H01R 12/716* (2013.01); *H01R 13/20* (2013.01)

USPC ..... 439/74

(58) Field of Classification Search

CPC ..... H01R 12/716; H01R 12/52; H01R 12/714

USPC ..... 439/74

See application file for complete search history.

(56) References Cited

U.S. PATENT DOCUMENTS

| | | | | |
|---|---|---|---|---|
| 7,278,861 | B2 * | 10/2007 | Kishi et al. | 439/74 |
| 7,410,364 | B2 * | 8/2008 | Kishi et al. | 439/74 |
| 7,736,177 | B2 * | 6/2010 | Tsai | 439/570 |
| 7,744,377 | B2 * | 6/2010 | Wu et al. | 439/74 |
| 7,985,099 | B2 * | 7/2011 | Wu | 439/626 |

FOREIGN PATENT DOCUMENTS

| | | |
|---|---|---|
| JP | 09-213432 | 8/1997 |
| JP | 10-041025 | 2/1998 |

* cited by examiner

*Primary Examiner* — Xuong Chung Trans
(74) *Attorney, Agent, or Firm* — IPUSA, PLLC

(57) ABSTRACT

A connector includes a plug connector including a projecting part and a plurality of plug electrodes, each plug electrode includes a first surface and a second plug surface that are substantially parallel to each other, and a jack connector including a plurality of jack electrodes, each jack electrode contacts to one of the plug electrodes when the plug connector is engaged with the jack connector, that includes a first jack contact part that contacts with the first plug surface, a second jack contact part that contacts with the second plug surface, and a third jack contact part that contacts with the projecting part. The projecting part is configured to exert a force to the third jack contact part to move the first jack contact part toward the first plug surface when engaging the plug connector and the jack connector.

6 Claims, 12 Drawing Sheets

100

CONNECTOR AND METHOD FOR CONNECTING THE CONNECTOR

CROSS-REFERENCE TO RELATED APPLICATIONS

This application is based upon and claims the benefit of priority of the prior Japanese Patent Application No. 2012-117974 filed on May 23, 2012, the entire contents of which are hereby incorporated by reference.

BACKGROUND

1. Field of the Invention

The present invention generally relates to a connector and a method for connecting the connector.

2. Description of the Related Art

Typically, a connection member such as a connector is used for electrically connecting substrates together. Among various connection members, a connector electrically connects one substrate to another substrate, for example, by engaging a plug connector to a jack connector in a state where the plug connector is provided to the one substrate whereas the jack connector is provided to the other substrate (see, for example, Japanese Laid-Open Patent Publication Nos. 09-213432 and 10-41025).

From the aspect of space-reduction or the like, a connector connecting substrates together is desired to have low height. However, in a case where the height of the connector is reduced, a clicking feel generated when connecting the connector is reduced. Furthermore, the connecting strength between connectors is also reduced in the case where the height of the connector is reduced. In the case where the connecting strength between connectors is small, the connectors are easily disengaged even by a small amount of force. This makes it difficult for the connector to maintain a desired connected state. Thus, the function of the connector is degraded.

SUMMARY

An embodiment of the present invention provides a connector including a plug connector including a projecting part and a plurality of plug electrodes, each plug electrode includes a first surface and a second plug surface that are substantially parallel to each other, and a jack connector including a plurality of jack electrodes, each jack electrode contacts to one of the plug electrodes when the plug connector is engaged with the jack connector, that includes a first jack contact part that contacts with the first plug surface, a second jack contact part that contacts with the second plug surface, and a third jack contact part that contacts with the projecting part, wherein the projecting part is configured to exert a force to the third jack contact part to move the first jack contact part toward the first plug surface when engaging the plug connector and the jack connector.

Other objects and further features of the present invention will be apparent from the following detailed description when read in conjunction with the accompanying drawings.

DESCRIPTION OF EMBODIMENTS

Figure 1:
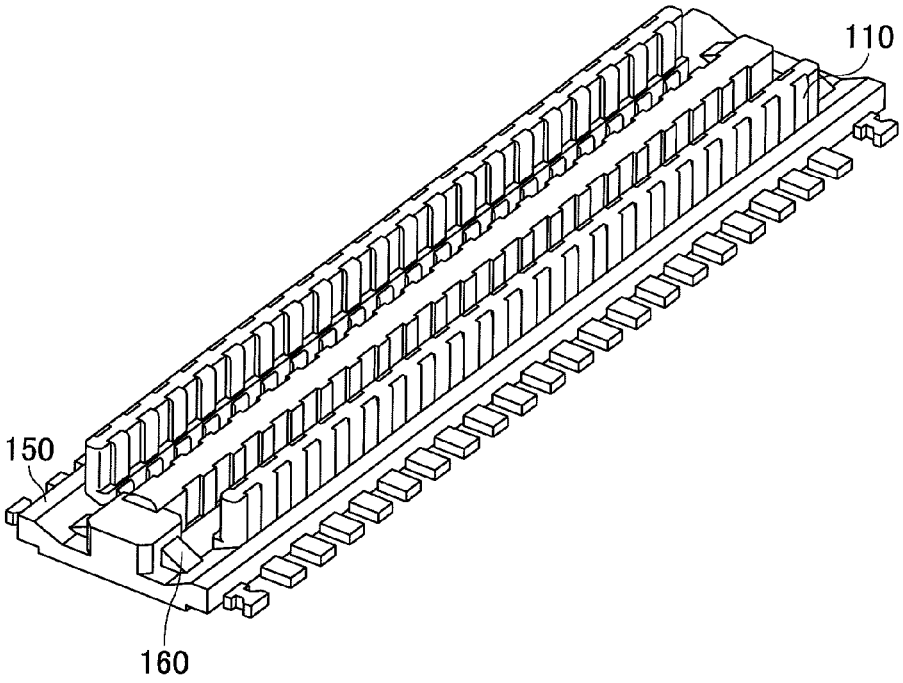
FIG. 1 is a perspective view of a plug connector according to an embodiment of the present invention.

In the following, embodiments of the present invention are described with reference to the accompanying drawings. It is to be noted that like components are denoted with like reference numerals throughout the following description and drawings.

[Structure of Connector]

A structure of a connector 10 according to an embodiment of the present invention is described with reference to FIGS. 1 to 11. The connector 10 according to the embodiment includes a plug connector 100 illustrated in FIGS. 1-4 and a jack connector 200 illustrated in FIGS. 5-8.

Figure 2:
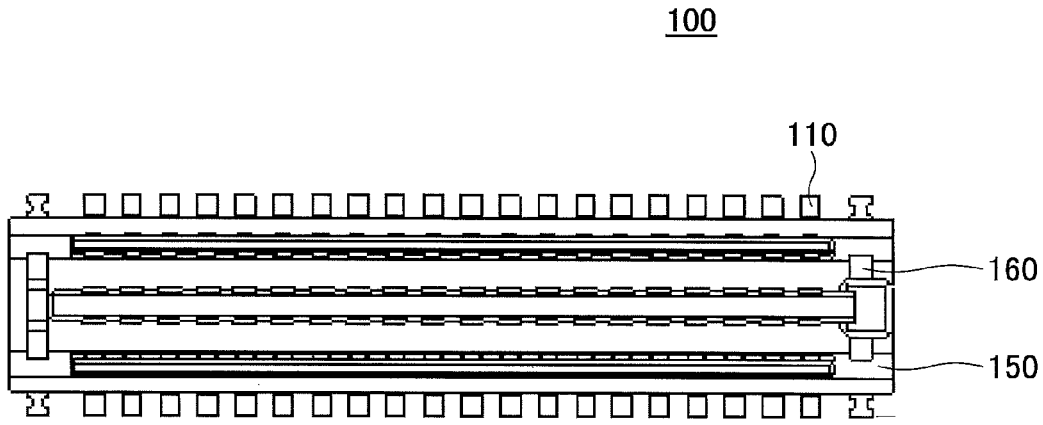
FIG. 2 is a top view of a plug connector according to an embodiment of the present invention.
Figure 3:
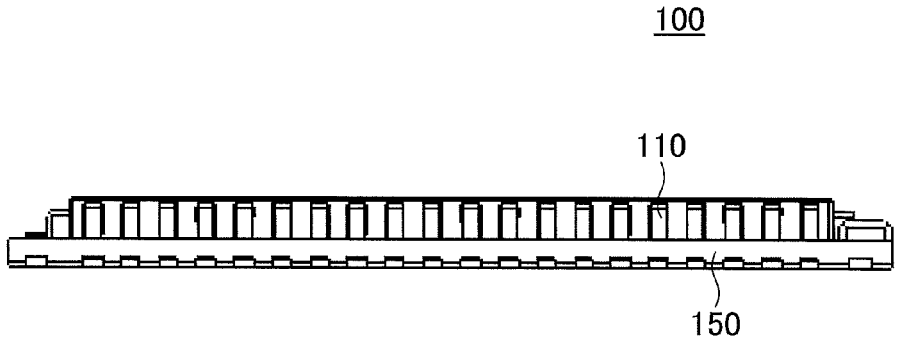
FIG. 3 is a side view of a plug connector according to an embodiment of the present invention.
Figure 4:
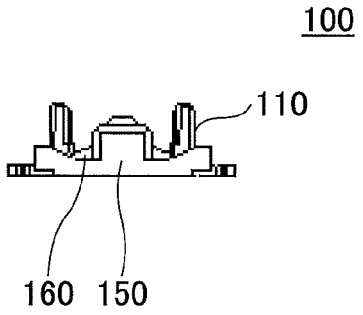
FIG. 4 is a front view of a plug connector according to an embodiment of the present invention.

FIG. 1 is a perspective view of the plug connector 100 according to the embodiment. FIG. 2 is a top view of the plug connector 100 according to the embodiment. FIG. 3 is a side view of the plug connector 100 according to the embodiment. FIG. 4 is a front view of the plug connector 100 according to the embodiment.

Figure 5:
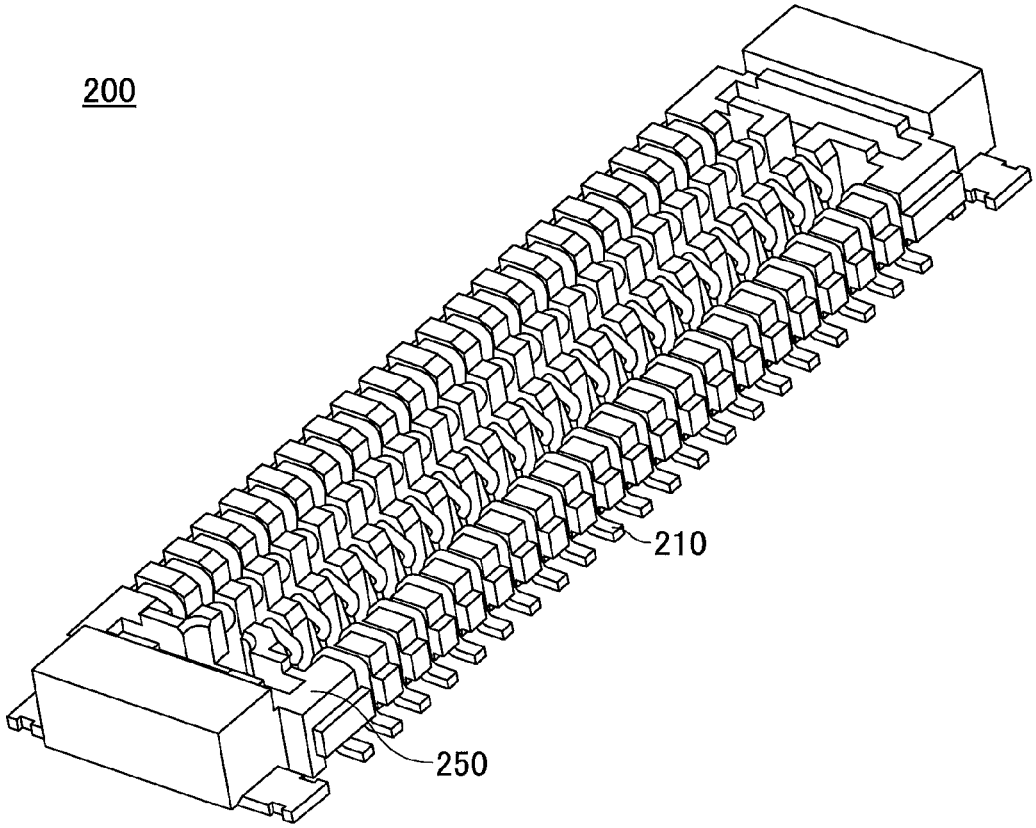
FIG. 5 is a perspective view of a jack connector according to an embodiment of the present invention.
Figure 6:
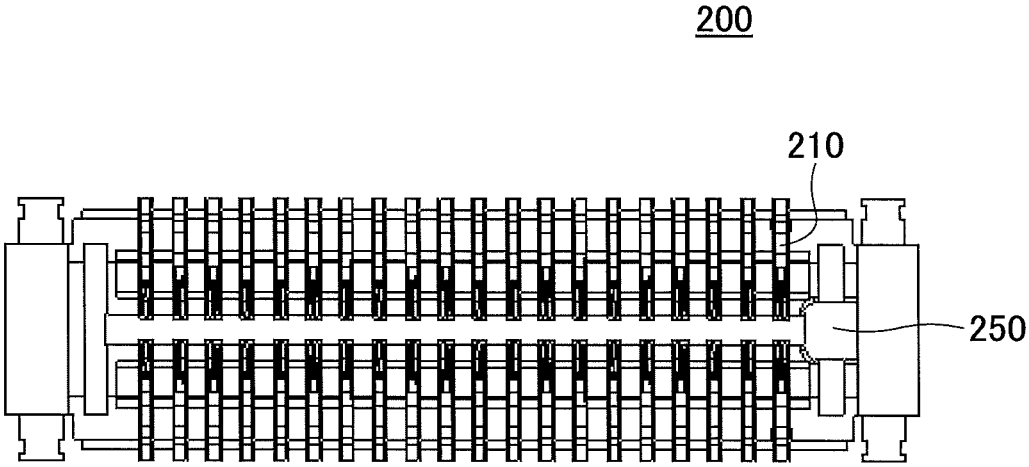
FIG. 6 is a top view of a jack connector according to an embodiment of the present invention.
Figure 7:
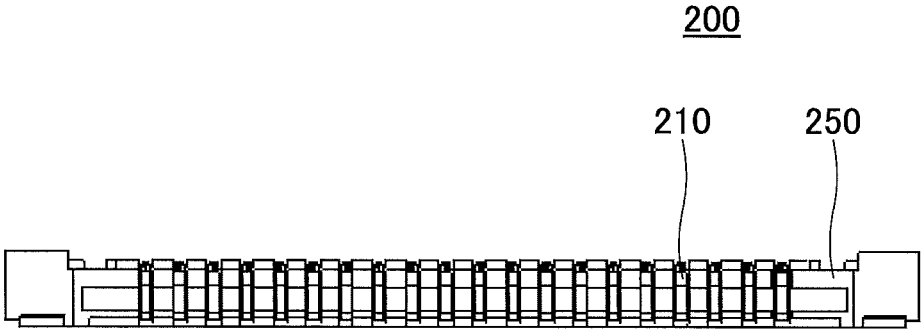
FIG. 7 is a side view of a jack connector according to an embodiment of the present invention.
Figure 8:
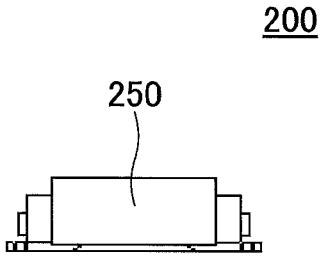
FIG. 8 is a front view of a jack connector according to an embodiment of the present invention.

FIG. 5 is a perspective view of the jack connector 200 according to the embodiment. FIG. 6 is a top view of the jack connector 200 according to the embodiment. FIG. 7 is a side view of the jack connector 200 according to the embodiment. FIG. 8 is a front view of the jack connector 200 according to the embodiment.

The plug connector 100 includes plural plug electrodes 110 and a casing 150 having the plug electrodes 110 fixed thereto. The plug electrodes 110 are arranged in a single direction with a pitch of, for example, 0.35 mm. The casing 150 is formed of, for example, a resin material having an insulating property.

The jack connector 200 includes plural jack electrodes 210 corresponding to the plug electrodes 110 and a casing 250 having the jack electrodes 210 fixed thereto. The jack electrodes 210 are arranged in a single direction. The casing 250 is formed of, for example, a resin material having an insulating property.

In order to ensure the strength of the plug connector 100 in a longitudinal direction of the plug connector 100, the plug connector 100 has a reinforcement member 160 provided inside the casing 150. The reinforcement member 160 may be formed with, for example, a metal component that is referred to as a peg.

Figure 9:
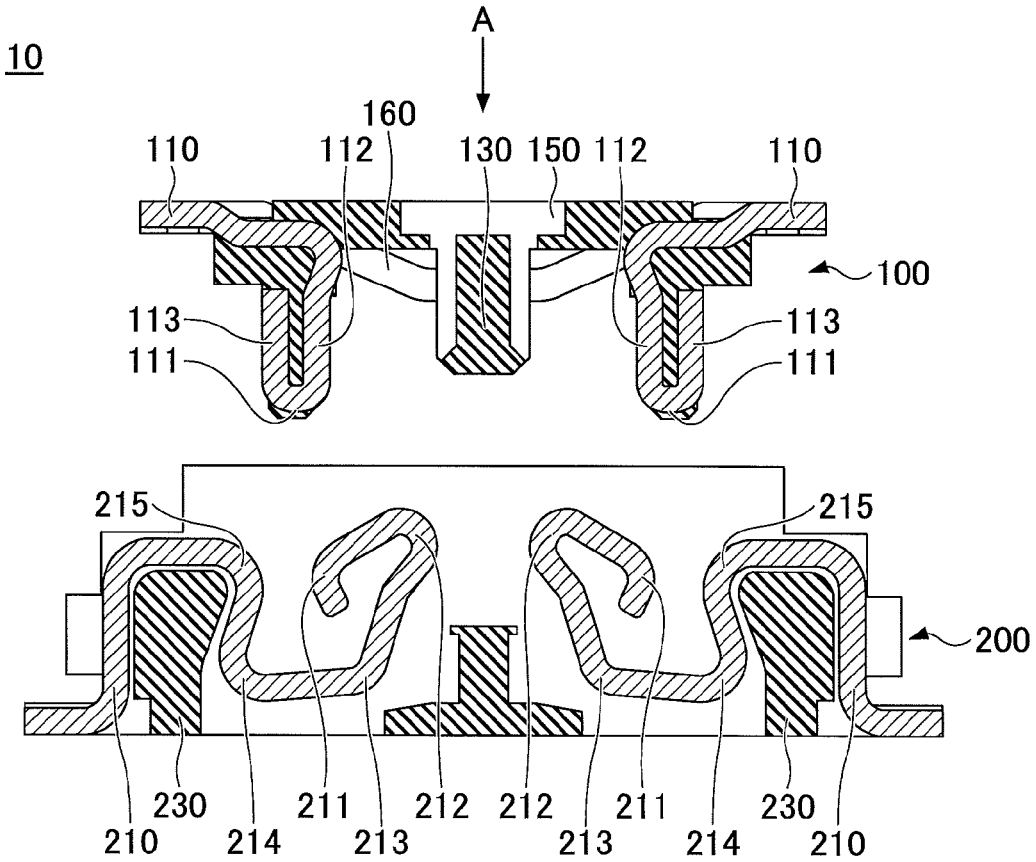
FIG. 9 is a schematic diagram illustrating a state before connecting a plug connector and a jack connector of a connector according to an embodiment of the present invention.

As illustrated in FIG. 9, a projecting part 130 having a convex shape is provided at a center portion of the plug connector 100. The projecting part 130 is formed of a resin material. The plug electrode 110 is provided on both sides of the projecting part 130. The plug electrode 110 is formed by bending a thin elongated metal plate. The electrode 110 includes a plug bend part 111, a first plug surface 112, and a second plug surface 113 that are formed by bending the plug bend part 111. The first plug surface 112 and the second plug surface 113 are positioned opposite to each other by way of the plug bend part 111. The plug electrode 110 according to the embodiment is arranged in a manner that the plug bend part 111 is positioned on a side of the plug connector 100 to which the jack connector 220 is connected. The first surface 112 and the second plug surface 113 of the plug electrode 110 are formed to be substantially parallel to a direction in which the plug connector 100 is inserted to the jack connector 200 (illustrated with arrow A in FIG. 9).

As illustrated in FIG. 9, the jack connector 200 according to the embodiment has the jack electrode 210 provided in correspondence with the plug electrode 110 of the plug connector 100. Similar to the plug electrode 110, the jack electrode 210 is also formed by bending a thin elongated metal plate. The jack electrode 210 includes a first jack bend part 211, a second jack bend part 212, a third jack bend part 213, a fourth jack bend part 214, and a fifth jack bend part 215 that are arranged in this order from one end of the jack electrode 210. In this embodiment, a first jack contact part is formed by the first jack bend part 211, a second jack contact part is formed by the fifth jack bend part 215, and a third jack contact part is formed by the second jack bend part 212. The jack electrode 210 is formed with a spring-like (resilient) property. The jack electrode 210 is supported by a jack electrode support part 230 that is provided more toward the other end of the jack electrode 210 than the fifth jack bend part 215. The jack electrode support part 230 is formed of, for example, a resin material.

Figure 10:
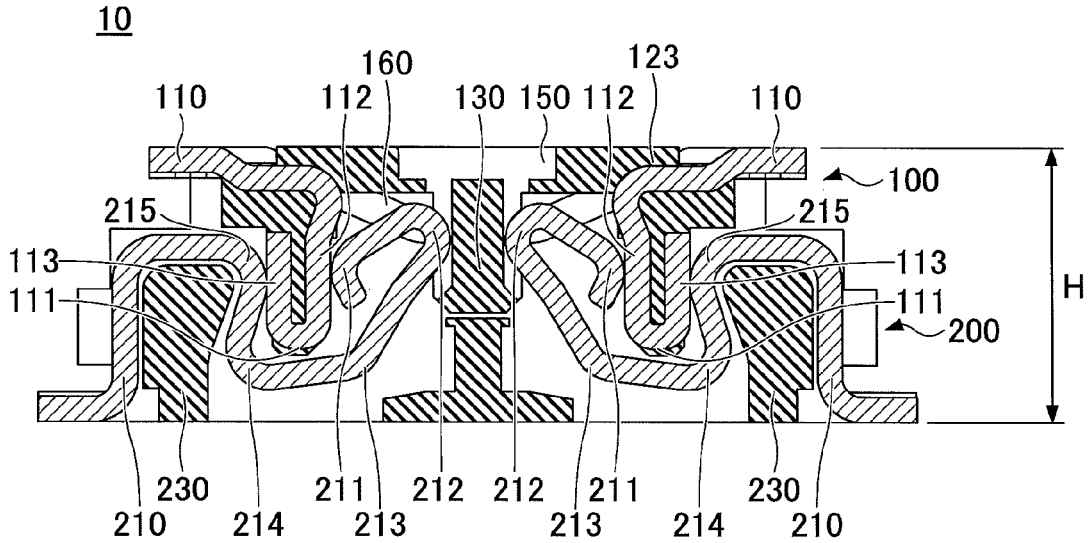
FIG. 10 is a schematic diagram illustrating a connected state of a plug connector and a jack connector of a connector according to an embodiment of the present invention.
Figure 11:
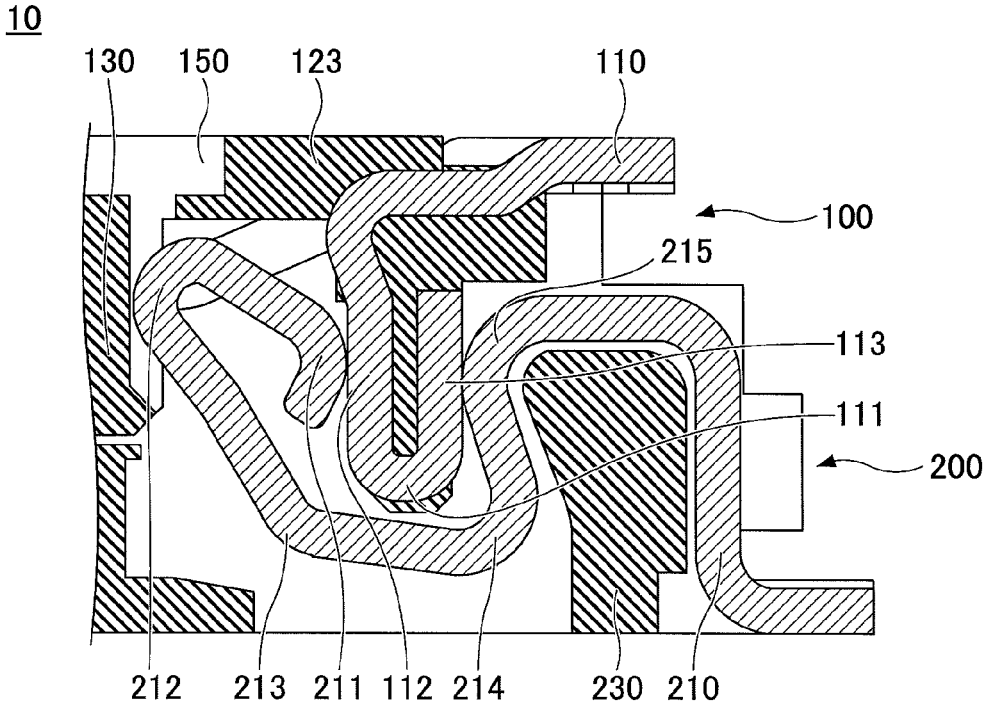
FIG. 11 is an enlarged view illustrating a portion of a connector illustrated in FIG. 10.

An example of the plug connector 100 and the jack connector 200 in an engaged (connected) state is described with reference to FIGS. 10 and 11. FIG. 11 is an enlarged view illustrating a portion of the connector 10 of FIG. 10 having the plug connector 100 and the jack connector 200 in the connected state. In the state where the plug connector 100 and the jack connector 200 are engaged as illustrated in FIGS. 10 and 11, the plug electrode 110 and the jack electrode 210 contact each other at two contact points. More specifically, the first plug surface 112 of the plug electrode 110 and the first jack bend part 211 of the jack electrode 211 contact each other, and the second plug surface 113 of the plug electrode 110 and the fifth jack bend part 215 of the jack electrode 210 contact each other. The plug connector 100 and the jack connector 200 are formed so that the connector 10 has a predetermined height H (e.g., approximately 0.8 mm or approximately 1.5 mm) in the engaged state.

The jack electrode 210 has a spring-like (resilient) property. The jack electrode 210 is formed so that a recovering force generated by the spring-like property of the jack electrode 210 causes the first jack bend part 211 and the fifth jack bend part 215 to move toward each other (move in a direction in which a space between the first jack bend part 211 and the fifth jack bend part 215 becomes narrower) in the engaged state. Accordingly, in the engaged state, the recovering force exerted toward the space between the first jack bend part 211 and the fifth jack bend part 215 of the jack electrode 210 forces the first and the fifth jack bend parts 211, 215 to secure the plug electrode 110 therebetween. Thereby, the connector 10 attains a structure that prevents disengagement of the engaged state of the plug connector 100 and the jack connector 200.

(Connection of Connector)

Next, connection of the connector 10 according to the embodiment is described. FIGS. 12-16 are schematic diagrams illustrating a portion of the connector 10 according to the embodiment for describing the connection of the connector 10 in separate stages. For the sake of convenience, a portion of the connector 10 is omitted from FIGS. 12-16.

Figure 17:
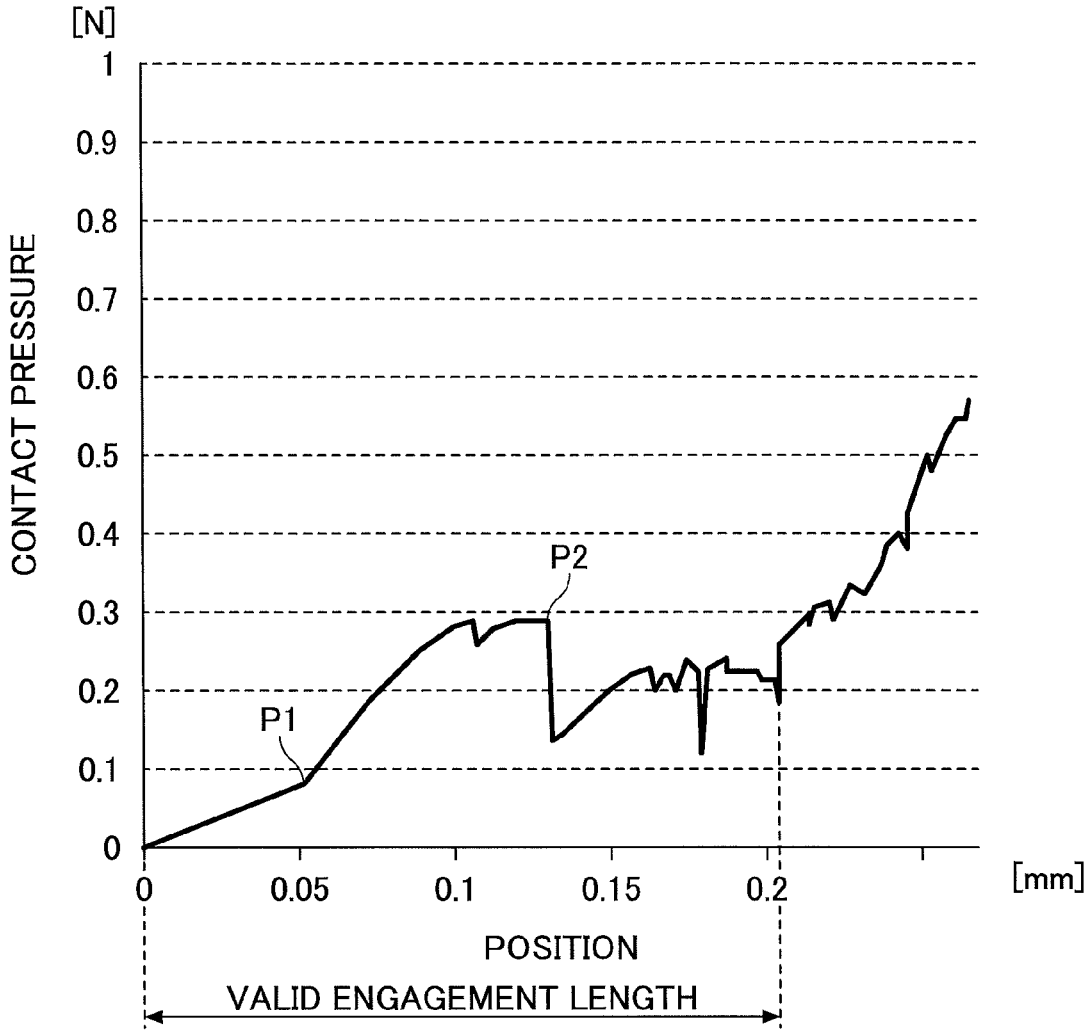
FIG. 17 is a graph illustrating the results of analyzing the contact pressure of a connector according to an embodiment of the present invention.

FIG. 17 is a graph illustrating the results of analyzing the contact pressure of the connector 10 according to the embodiment. In FIG. 17, the horizontal axis represents a position of the plug connector 100 relative to the jack connector 200, and the vertical axis represents contact pressure between the plug connector 100 and the jack connector 200. The valid engagement length of FIG. 17 starts from a state where the plug connector 100 contacts the jack connector 200 and ends in a state where the plug connector 100 and the jack connector 200 are engaged.

The connection between the jack connector 200 and the plug connector 100 may be performed by, for example, moving the plug connector 100 in a direction indicated with arrow A of FIGS. 12-16 (hereinafter referred to as "arrow direction A") and engaging the plug connector 100 to the jack connector 200 in a state where the position of the jack connector 200 is fixed. Alternatively, in a case of connecting the plug connector 100 and the jack connector 200, the jack connector 200 may be moved in a direction toward the plug connector 100 instead of moving the plug connector 100 in a direction toward the jack connector 200.

Figure 12:
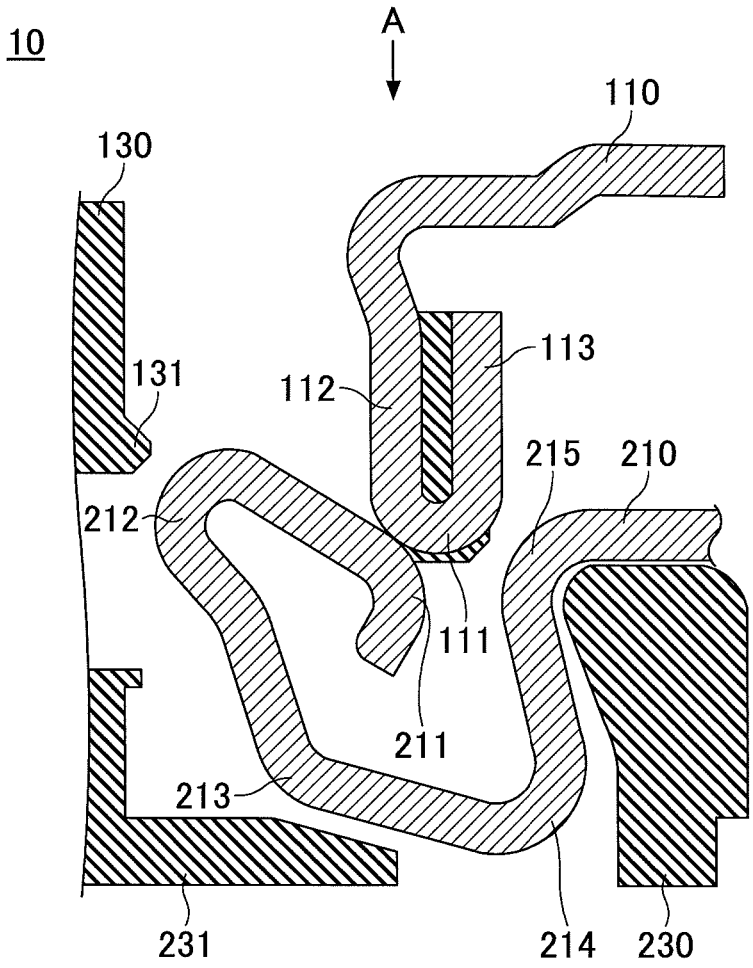
FIGS. 12-16 are schematic diagrams illustrating a portion of a connector according to an embodiment of the present invention for describing the connection of the connector in separate stages.

First, as illustrated in FIG. 12, the plug electrode 110 and the jack electrode 210 contact each other at the vicinity of the plug bend part 111 and the vicinity of the first jack bend part 211 by moving the plug connector 100 in the arrow direction A from the state where the plug connector 100 and the jack connector 200 are separated. Then, by moving the plug connector 100 further in the arrow direction A, the first jack bend part 211 of the jack electrode 210 is pressed by the plug bend part 111 of the plug electrode 110, and the space between the first jack bend part 211 and the fifth jack bend part 215 of the jack electrode 210 becomes wider. In the state illustrated in FIG. 12, the spring-like property of the jack electrode 210 generates a recovering force that causes the first jack bend part 211 to move toward the fifth jack bend part 215.

Figure 13:
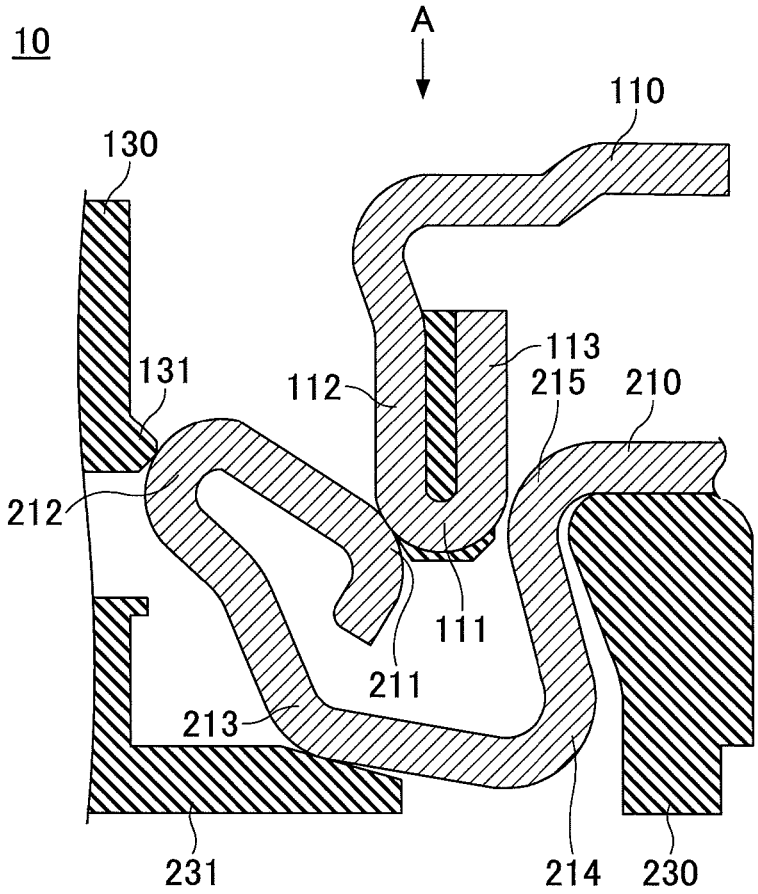

Then, as illustrated in FIG. 13, by moving the plug connector 100 further in the arrow direction A, the first jack bend part 211 of the jack electrode 210 is further pressed by the plug bend part 111, and the space between the first jack bend part 211 and the fifth jack bend part 215 of the jack electrode 210 becomes further wider compared to the state illustrated in FIG. 12. In addition, a convex-shaped tip part 131 of the projecting part 130 of the plug connector 100 contacts the second jack bend part 212 of the jack electrode 210. It is to be noted that the contacting state illustrated in FIG. 13 corresponds to a state indicated as "P1" in FIG. 17.

Figure 14:
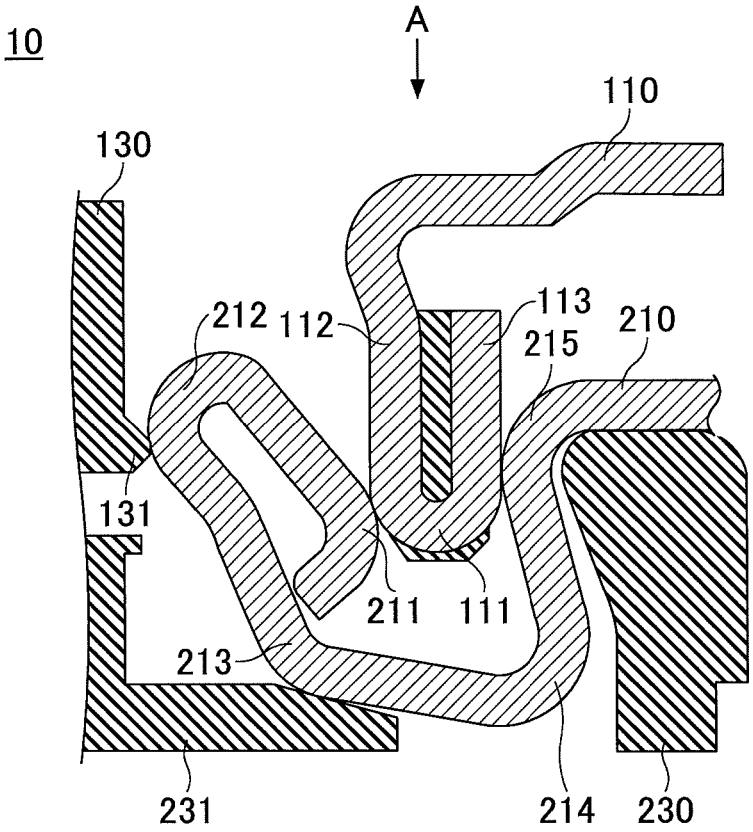

Then, as illustrated in FIG. 14, by moving the plug connector 100 further in the arrow direction A, the plug bend part 111 of the plug electrode 110 enters the space between the first jack bend part 211 and the fifth jack bend part 215 of the jack electrode 210, and the space between the first jack bend part 211 and the fifth jack bend part 215 of the jack electrode 210 becomes further wider compared to the state illustrated in FIG. 13. In the state illustrated in FIG. 14, contact between the plug electrode 110 and the jack electrode 210 is achieved by the contact between the first plug surface 112 of the plug electrode 110 and the first jack bend part 211 of the jack electrode 210 and the contact between the second plug surface 113 of the plug electrode 110 and the fifth jack bend part 215 of the jack electrode 210. That is, the first plug surface 112 and the first jack bend part 211 contact each other, and the second plug surface 113 and the fifth jack bend part 215 contact each other.

In the state illustrated in FIG. 14, the third jack bend part 213 of the jack electrode 210 contacts a jack bottom part 231 of the jack connector 200 due to the second jack bend part 212 of the jack electrode 210 being pressed by the convex-shaped tip part 131. The jack bottom part 231 is formed of, for example, a resin material. After the convex-shaped tip part 131 of the projecting part 130 and the second jack bend part 212 contact each other, the first jack bend part 211 exerts a greater force to the first plug surface 112 compared to the state illustrated in FIG. 13 by moving the plug connector 100 further in the arrow direction A such that the second jack bend part 212 is further pressed by the convex-shaped tip part 131 of the projecting part 130. In the state where the second jack bend part 212 is further pressed by the convex-shaped tip part 131 of the projecting part 130, the spring-like property of the jack electrode 210 generates a recovering force that causes the third jack bend part 213 to move in a direction separating from the jack bottom part 231.

Figure 15:
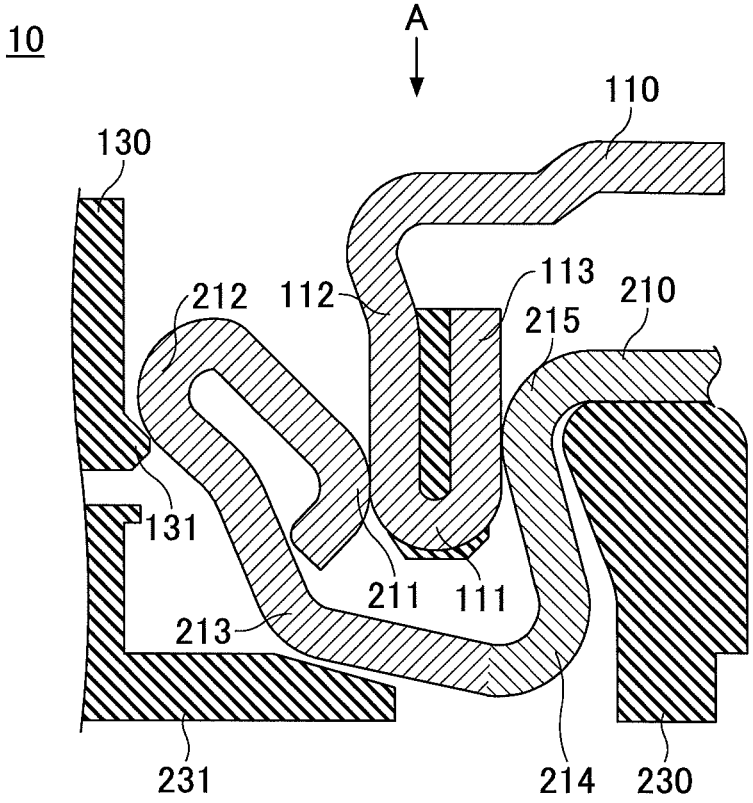

Then, as illustrated in FIG. 15, by moving the plug connector 100 further in the arrow direction A, the plug bend part 111 of the plug electrode 110 further enters the space between the first jack bend part 211 and the fifth jack bend part 215 of the jack electrode 210 compared to the state illustrated in FIG. 14 in a state where the first plug surface 112 of the plug electrode 110 and the first jack bend part 211 of the jack electrode 210 contact each other, and the second plug surface 113 of the plug electrode 110 and the fifth jack bend part 215 of the jack electrode 210 contact each other.

Figure 16:
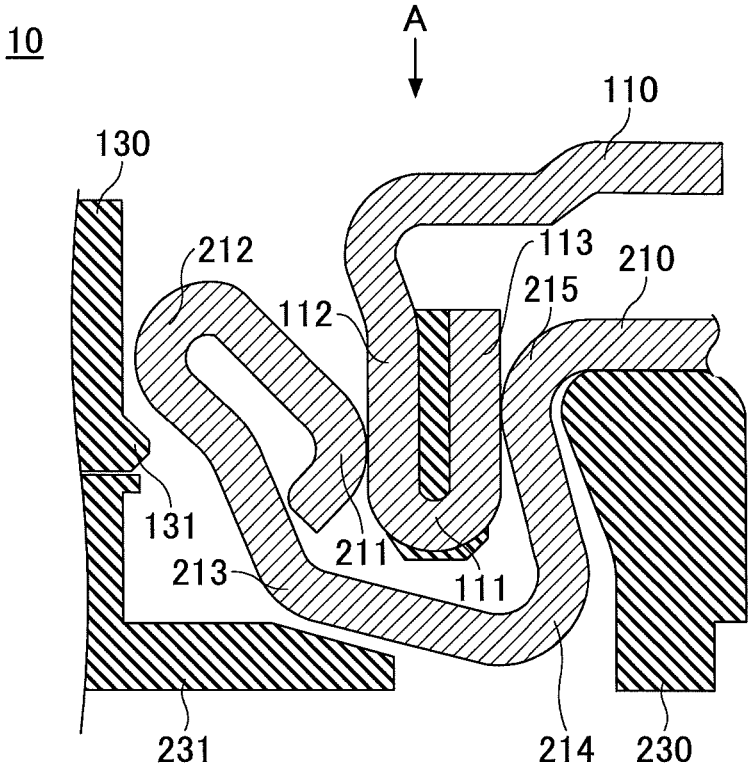

In the state illustrated in FIG. 15, the convex-shaped tip part 131 of the projecting part 130 presses against the second jack bend part 212, displaces the second jack bend part 212, and further advances in the arrow direction A. Thereby, the convex-shaped tip part 131 is separated from the second jack bend part 212 and no longer contacts the second jack bend part 212 as illustrated in FIG. 16. Because the force exerted to the convex-shaped tip part 131 by way of the second jack bend part 212 significantly changes when the convex-shaped tip part 131 and the second jack bend part 212 become separated, a strong clicking feel can be generated and transmitted to the user of the connector 10. It is to be noted that the contacting state illustrated in FIG. 15 corresponds to a state indicated as "P2" in FIG. 17.

Then, as illustrated in FIG. 16, by moving the plug connector 100 further in the arrow direction A, the plug bend part 111 further enters the space between the space between the first jack bend part 211 and the fifth jack bend part 215 of the jack electrode 210 compared to the state illustrated in FIG. 15, in a state where the first plug surface 112 and the first jack bend part 211 contact each other, and the second plug surface 113 and the fifth jack bend part 215 contact each other.

In the state illustrated in FIG. 16, the plug electrode 110 is retained in a manner that the first plug surface 112 and the second plug surface 113 are sandwiched between the first and the fifth jack bend parts 211, 215. In the state where the first plug surface 112 and the second plug surface 113 are sandwiched between the first and the fifth jack bend parts 211, 215, a recovering force, forcing the space between the first and the fifth jack bend parts 211, 215 to become narrower, is exerted to the jack electrode 210.

Owing to the recovering force, the plug electrode 110 can be firmly secured between the first and the fifth jack bend parts 211, 215 of the jack electrode 210. Accordingly, the plug electrode 110 and the jack electrode 210 cannot be easily separated. That is, the engaged state of the plug connector 100 and the jack connector 200 cannot be easily disengaged.

With the above-described embodiment, the connector can generate a strong clicking feel when connecting the connector and attain a large connecting strength when the jack connector and the plug connector of the connector are in an engaged state.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A connector comprising:

a plug connector including a projecting part and a plurality of plug electrodes, each plug electrode includes a first plug surface and a second plug surface that are substantially parallel to each other; and a jack connector including a plurality of jack electrodes, each jack electrode contacts to one of the plug electrodes when the plug connector is engaged with the jack connector, that includes a first jack contact part that contacts with the first plug surface, a second jack contact part that contacts with the second plug surface, and a third jack contact part that contacts with the projecting part;

wherein the projecting part is configured to exert a force to the third jack contact part to move the first jack contact part toward the first plug surface when engaging the plug connector and the jack connector.

2. The connector as claimed in claim 1, wherein in a state where the plug connector and the jack connector are engaged, the first plug surface and the first jack contact part contact each other, and the second plug surface and the second jack contact part contact each other.

3. The connector as claimed in claim 1, wherein the projecting part has a convex-shaped tip that contacts with the third jack contact part.

4. The connector as claimed in claim 1, wherein the first jack contact part and the second jack contact part are configured to secure the plug electrode therebetween by the contact between the first plug surface and the first jack contact part and the contact between the second plug surface and the second jack contact part.

5. The connector as claimed in claim 4, wherein the jack electrode has a spring-like property that generates a recovering force exerted toward a space between the first and second jack contact parts, and wherein the plug electrode is secured between the first and second jack contact parts by the recovering force generated by the spring-like property of the jack electrode.

6. A method for connecting a connector including a plug connector and a jack connector, the plug connector including a projecting part and a plurality of plug electrodes, each plug electrode including first and second plug surfaces that are substantially parallel to each other, the jack connector including a plurality of jack electrodes, each jack electrode including first, second, and third jack contact parts, the method comprising:

relatively moving the plug connector and the jack connector in a predetermined direction, so that the first plug surface and the first jack contact part contact each other, the second plug surface and the second jack contact part contact each other, and the projecting part contacts the third jack contact part and exerts a force to the third jack contact part that causes the first jack contact part to move toward the first plug surface; and relatively moving the plug connector and the jack connector further in the predetermined direction, so that the first plug surface and the first jack contact part contact each other, the second plug surface and the second jack contact part contact each other, and the projecting part is separated from the third jack contact part;

wherein the plug electrode is secured between the first and second jack contact parts in a state where the first plug surface and the first jack contact part contact each other and the second plug surface and the second jack contact part contact each other.

* * * * *